US006122773A

United States Patent [19]

Katz

[11] Patent Number: 6,122,773

[45] Date of Patent: Sep. 26, 2000

[54] VENTILATED HARDHAT

[76] Inventor: Marc Katz, 23 Monmouth Ave., South Woodford London, England E18 1NU, United Kingdom

[21] Appl. No.: 09/292,581

[22] Filed: Apr. 15, 1999

[51] Int. Cl.[7] ..... A42B 3/28

[52] U.S. Cl. ..... 2/171.3; 2/422

[58] Field of Search ..... 2/171.3, 422, 411, 2/410; 362/103, 105, 106

[56] References Cited

U.S. PATENT DOCUMENTS

| | | | |
|---|---|---|---|
| D. 275,334 | 9/1984 | Pullin | D2/230 |
| 432,728 | 7/1890 | Eliel | 2/171.3 |
| 3,353,191 | 11/1967 | Dahly | 2/171.3 |
| 3,391,407 | 7/1968 | Waters | 2/171.3 |
| 3,548,415 | 12/1970 | Waters | 2/171.3 |
| 3,735,423 | 5/1973 | Droz | 2/171.3 |
| 3,881,198 | 5/1975 | Waters | 2/171.3 |
| 4,744,106 | 5/1988 | Wang | 2/171.3 |

*Primary Examiner*—Michael A. Neas

[57] ABSTRACT

A ventilated hardhat for helping keep the head of a wearer cool and ventilated. The ventilated hardhat includes a hardhat with an interior cavity and a bottom opening into the interior cavity for receiving a head of a user therein. The hardhat has a plurality of vent holes therethrough. A fan is mounted to the hardhat in the interior cavity. A motor is also mounted to the hardhat in the interior cavity for rotating the fan to draw air through the vent holes into the interior cavity.

12 Claims, 3 Drawing Sheets

VENTILATED HARDHAT

BACKGROUND OF THE INVENTION

1. Field of the Invention

The present invention relates to ventilated hardhats and more particularly pertains to a new ventilated hardhat for helping keep the head of a wearer cool and ventilated.

2. Description of the Prior Art

The use of ventilated hardhats is known in the prior art. More specifically, ventilated hardhats heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,744,106 by Wang; U.S. Pat. No. 3,353,191 by Dahly; U.S. Pat. No. Des. 275,334 by Pullin; U.S. Pat. No. 5,561,862 by Flores, Sr.; U.S. Pat. No. 3,735,423 by Droz; and U.S. Pat. No. 1,774,074 by Wittcoff.

While these devices fulfill their respective, particular objectives and requirements, the aforementioned patents do not disclose a new ventilated hardhat. The inventive device includes a hardhat with an interior cavity and a bottom opening into the interior cavity for receiving a head of a user therein. The hardhat has a plurality of vent holes therethrough. A fan is mounted to the hardhat in the interior cavity. A motor is also mounted to the hardhat in the interior cavity for rotating the fan to draw air through the vent holes into the interior cavity.

In these respects, the ventilated hardhat according to the present invention substantially departs from the conventional concepts and designs of the prior art, and in so doing provides an apparatus primarily developed for the purpose of helping keep the head of a wearer cool and ventilated.

SUMMARY OF THE INVENTION

In view of the foregoing disadvantages inherent in the known types of ventilated hardhats now present in the prior art, the present invention provides a new ventilated hardhat construction wherein the same can be utilized for helping keep the head of a wearer cool and ventilated.

The general purpose of the present invention, which will be described subsequently in greater detail, is to provide a new ventilated hardhat apparatus and method which has many of the advantages of the ventilated hardhats mentioned heretofore and many novel features that result in a new ventilated hardhat which is not anticipated, rendered obvious, suggested, or even implied by any of the prior art ventilated hardhats, either alone or in any combination thereof.

To attain this, the present invention generally comprises a hardhat with an interior cavity and a bottom opening into the interior cavity for receiving a head of a user therein. The hardhat has a plurality of vent holes therethrough. A fan is mounted to the hardhat in the interior cavity. A motor is also mounted to the hardhat in the interior cavity for rotating the fan to draw air through the vent holes into the interior cavity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ventilated hardhat apparatus and method which has many of the advantages of the ventilated hardhats mentioned heretofore and many novel features that result in a new ventilated hardhat which is not anticipated, rendered obvious, suggested, or even implied by any of the prior art ventilated hardhats, either alone or in any combination thereof.

It is another object of the present invention to provide a new ventilated hardhat which may be easily and efficiently manufactured and marketed.

It is a further object of the present invention to provide a new ventilated hardhat which is of a durable and reliable construction.

An even further object of the present invention is to provide a new ventilated hardhat which is susceptible of a low cost of manufacture with regard to both materials and labor, and which accordingly is then susceptible of low prices of sale to the consuming public, thereby making such ventilated hardhat economically available to the buying public.

Still yet another object of the present invention is to provide a new ventilated hardhat which provides in the apparatuses and methods of the prior art some of the advantages thereof, while simultaneously overcoming some of the disadvantages normally associated therewith.

Still another object of the present invention is to provide a new ventilated hardhat for helping keep the head of a wearer cool and ventilated.

Yet another object of the present invention is to provide a new ventilated hardhat which includes a hardhat with an interior cavity and a bottom opening into the interior cavity for receiving a head of a user therein. The hardhat has a plurality of vent holes therethrough. A fan is mounted to the hardhat in the interior cavity. A motor is also mounted to the hardhat in the interior cavity for rotating the fan to draw air through the vent holes into the interior cavity.

Still yet another object of the present invention is to provide a new ventilated hardhat that provides comfort to a wearer so that the wearer does not have to remove their hardhat in situations where the hardhat is needed for the safety of the wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
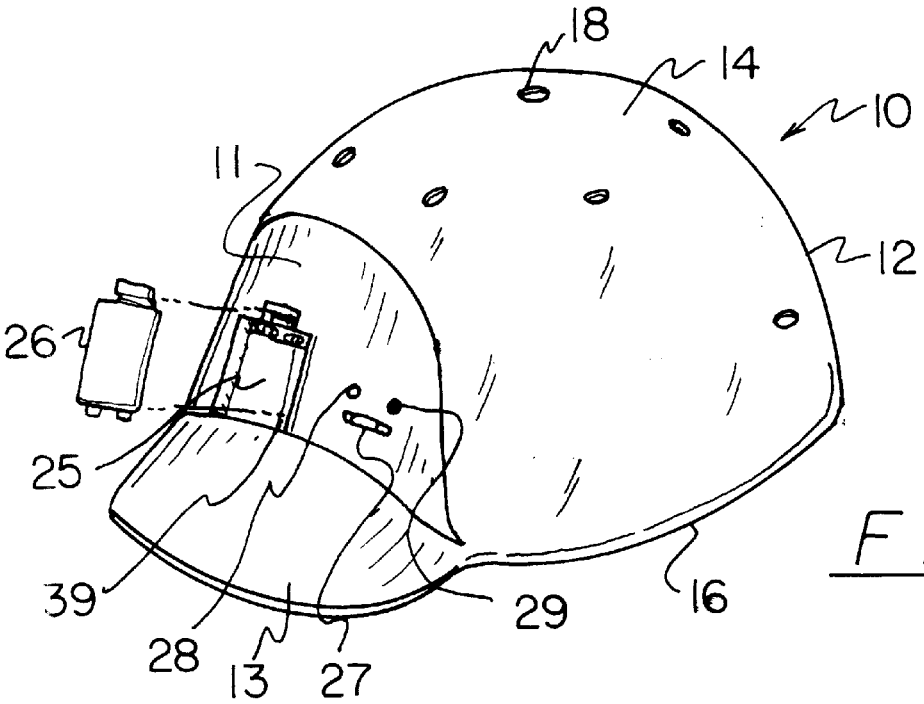
FIG. 1 is a schematic perspective view of a new ventilated hardhat according to the present invention with the access panel removed to expose the battery in the compartment.

With reference now to the drawings, and in particular to FIGS. 1 through 4 thereof, a new ventilated hardhat embodying the principles and concepts of the present invention will be described.

As best illustrated in FIGS. 1 through 4, the ventilated hardhat generally comprises a hardhat with an interior cavity and a bottom opening into the interior cavity for receiving a head of a user therein. The hardhat has a plurality of vent holes therethrough. A fan is mounted to the hardhat in the interior cavity. A motor is also mounted to the hardhat in the interior cavity for rotating the fan to draw air through the vent holes into the interior cavity.

In closer detail, the rigid hardhat 10 has a front 11, a back 12, a visor 13 outwardly extending from the front of the hardhat, an exterior surface 14, an interior cavity 15 and a bottom opening 16 into the interior cavity for receiving a head of a user therein. Preferably, the hardhat has a plurality of support struts 17 in the interior cavity between, the struts and the exterior surface of the hardhat defining therebetween an upper portion 38 of the interior cavity.

The hardhat has a plurality of vent holes 18 therethrough extending between the exterior surface and the interior cavity of the hardhat. The vent holes are preferably located in the upper portion of the interior cavity of the hardhat.

Figure 3:
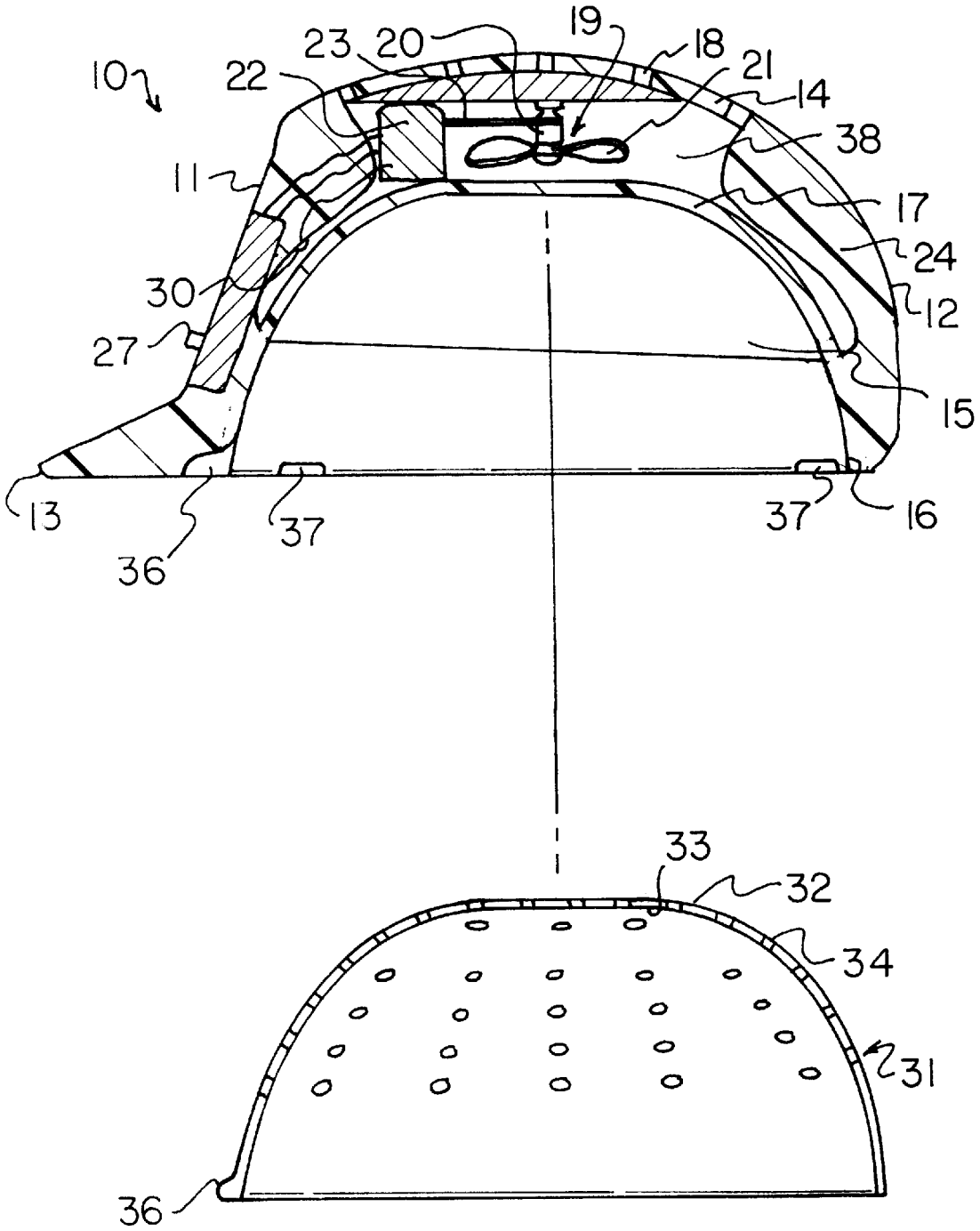
FIG. 3 is a schematic exploded cross sectional view of the present invention.
Figure 4:
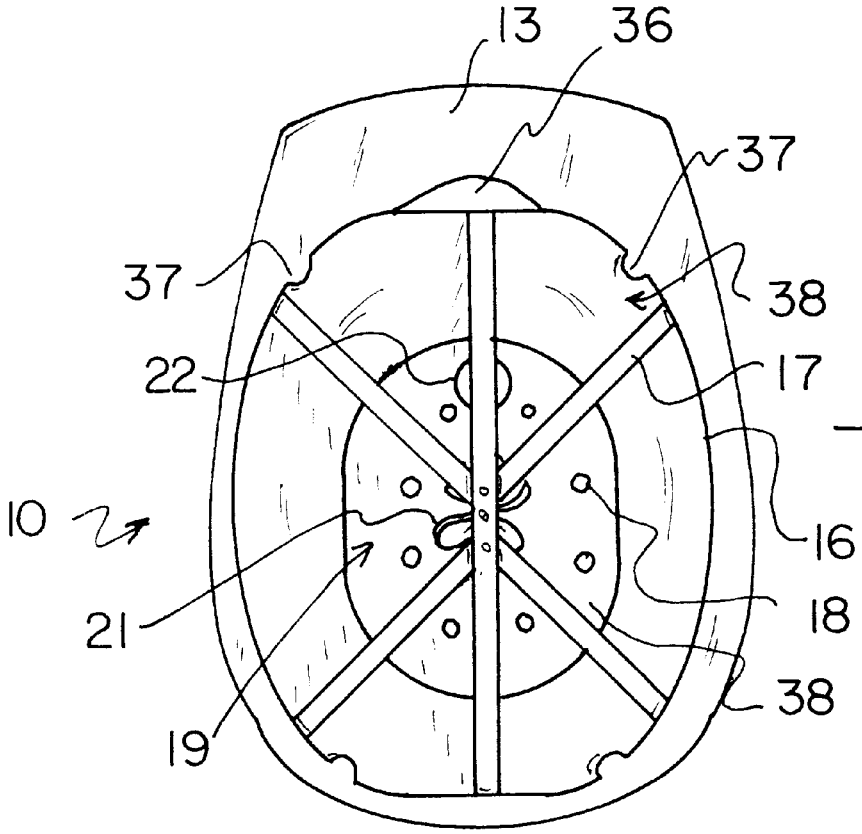
FIG. 4 is a schematic bottom view of the present invention with the liner removed.

A fan 19 or impeller is disposed in the upper portion of the interior cavity. The fan has a central hub 20 and a plurality of blades 21 outwardly radiating from the central hub of the fan. As illustrated in FIG. 3, the central hub of the fan is rotatably mounted to the hardhat to permit rotation of the fan in the upper portion of the interior cavity. In use, the fan draws air through the vent holes and forcing the drawn air downwards into the interior cavity when the fan is rotated. A motor 22 for rotating the fan is also mounted to the hardhat in the upper portion of the interior cavity adjacent to a side of the fan and preferably not above the fan to help keep the vertical profile of the motor and fan as low as possible. A drive member 23 operationally connects the motor to the fan to rotate the fan. Preferably, the drive member comprises an endless loop belt looped around the central hub of the fan and a rotating shaft portion of the motor to help keep the vertical profile of the fan and motor as low as possible.

The hardhat has a thickness defined between the exterior surface and the interior cavity. As best illustrated in FIG. 3, the thickness of the hardhat in the upper portion of the interior cavity is preferably less than the thickness of the hardhat in a remainder portion 24 between the exterior surface and the interior cavity of the hardhat. This helps keep the vertical profile of the hardhat as low as possible while still permitting the mounting of the fan and motor in the interior cavity.

A battery 25 is electrically connected to the motor for providing electrical energy to the motor to energize the motor. The battery is disposed in a compartment 39 in the front of the hardhat that has a removable access panel 26 closing the compartment and enclosing the battery in the compartment. A switch is electrically connected to the motor for selectively activating and deactivating the motor to rotate the fan. The switch has an actuator 27 is mounted to the front of the hardhat. The switch also preferably has a pair of light sources 28,29 on the front of said hardhat for indicating when the motor is activated and deactivated by the switch. In use, one of the light sources is illuminated when the motor is deactivated by the switch while the other of the light sources is illuminated when the motor is activated by the switch.

In a preferred embodiment, a temperature sensor 30 is mounted to the hardhat in the interior cavity. The temperature sensor is electrically connected to the motor. The temperature sensor generates a first signal to the motor when the temperature sensor detects a temperature in the interior cavity greater than a first predetermined temperature. The motor activates to rotate the fan upon receipt of the first signal from the temperature sensor. Even more preferably, the temperature sensor generates a second signal to the motor when the temperature sensor detects a temperature in the interior cavity less than a second predetermined temperature (the second predetermined temperature being less or lower than the first predetermined temperature). The motor deactivating to stop rotating the fan upon receipt of the second signal from the temperature sensor.

Figure 2:
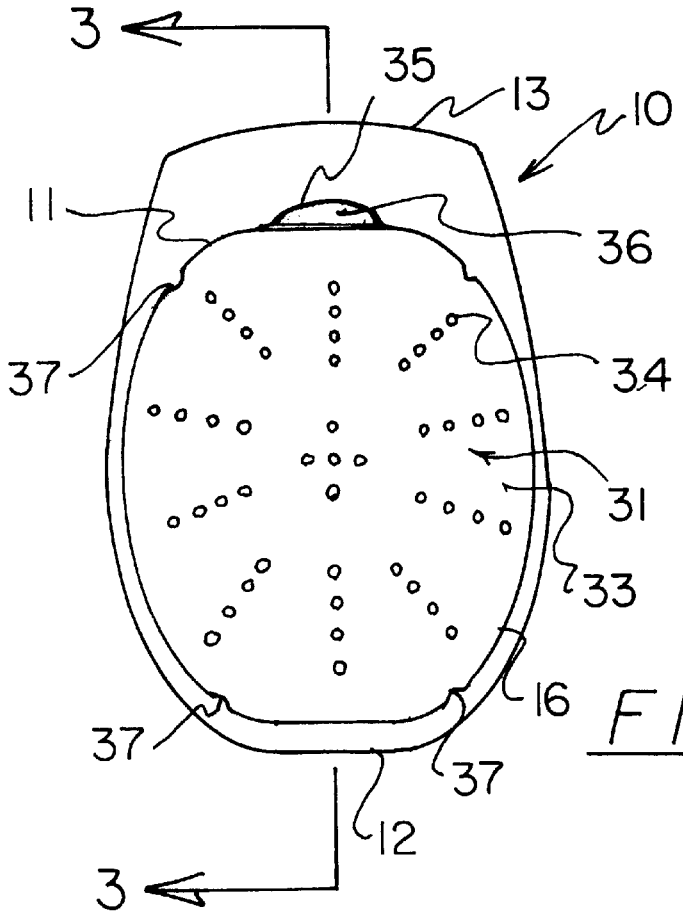
FIG. 2 is a schematic bottom view of the present invention.

Preferably, a rigid liner 31 is inserted into the interior cavity between the struts and the bottom opening into the interior cavity. The liner has a convex exterior surface 32 and a concave interior surface 33 defining a space designed for receiving the head of a user therein. The liner has a plurality of spaced apart apertures 34 therethrough extending between the exterior and interior surface of the liner to permit passage of air through the liner. Ideally, as best illustrated in FIGS. 2 and 3, a number of the apertures of the liner are arranged in a plurality of rows outwards radiating from upper central portion of the liner.

Preferably, the interior cavity has a front recess 35 adjacent the bottom opening into the cavity and positioned towards the front of the hardhat. The liner has a corresponding front lip 36 outwardly extending therefrom. The front lip is extended into the front recess of the interior cavity when the liner is inserted into the interior cavity to help hold the liner against rotation the interior cavity. The hardhat also preferably has a plurality of spaced apart resilient tangs 37 extending inwardly into the interior cavity adjacent the bottom opening. The tangs are positioned adjacent a bottom rim of the liner when the liner is in the interior cavity to releasably hold the liner in the interior cavity between the struts and the bottom opening.

In use, the fan draws air down into the interior cavity through the vent holes and blowing the air into the liner through the apertures to circulate air around the head of the user to help keep the user's head cool when wearing the hardhat. The motor is activated to rotate the fan when the temperature sensor detects the temperature inside the interior cavity rising above an upper limit predetermined temperature (the first predetermined temperature) The temperature sensor deactivates the motor once sufficient air has been blown in by the fan to reduce the temperature in the interior cavity below a lower limit predetermined temperature (the second predetermined temperature) less than the upper limit predetermined temperature.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article of headwear, comprising:

a hardhat having an interior cavity and a bottom opening into said interior cavity for receiving a head of a user therein;

said hardhat having a plurality of vent holes therethrough;

a fan being mounted to said hardhat in said interior cavity;

a motor being mounted to said hardhat in said interior cavity for rotating said fan, said fan drawing air through said vent holes into said interior cavity when rotated by said motor; and a temperature sensor being mounted to said hardhat in said interior cavity, said temperature sensor being electrically connected to said motor, said temperature sensor generating a first signal to said motor when said temperature sensor detects a temperature in said interior cavity greater than a first predetermined temperature, said motor activating to rotate said fan upon receipt of said first signal from said temperature sensor.

2. The article of headwear of claim 1, wherein said hardhat has a plurality of support struts in said interior cavity, said struts and an exterior surface of said hardhat defining therebetween an upper portion of said interior cavity, said fan and motor being located in said upper portion of said interior cavity.

3. The article of headwear of claim 2, wherein said hardhat has a thickness defined between said exterior surface and said interior cavity, wherein said thickness of said hardhat in said upper portion of said interior cavity being less than said thickness of said hardhat in a remainder portion between said exterior surface and said interior cavity of said hardhat.

4. The article of headwear of claim 1, wherein a battery is electrically connected to said motor, said battery being disposed in a compartment in said hardhat.

5. The article of headwear of claim 1, further comprising a switch electrically connected to said motor, said switch being mounted to said exterior surface of said hardhat.

6. The article of headwear of claim 5, wherein said switch has a pair of light sources on said front of said hardhat for indicating when said motor is activated and deactivated by said switch, one of said light sources being illuminated when said motor is deactivated by said switch, the other of said light sources being illuminated when said motor is activated by said switch.

7. The article of headwear of claim 1, wherein said temperature sensor generates a second signal to said motor when said temperature sensor detects a temperature in said interior cavity less than a second predetermined temperature, said second predetermined temperature being less or lower than said first predetermined temperature, said motor deactivating to stop rotating said fan upon receipt of said second signal from said temperature sensor.

8. The article of headwear of claim 1, further comprising a liner being inserted into said interior cavity, said liner having a plurality of apertures therethrough.

9. The article of headwear of claim 8, wherein said interior cavity has a front recess adjacent said bottom opening into said cavity and positioned towards said front of said hardhat, wherein said liner has a front lip outwardly extending therefrom, wherein said front lip is extended into said front recess of said interior cavity.

10. The article of headwear of claim 8, wherein said hardhat has a plurality of spaced apart resilient tangs extending inwardly into said interior cavity adjacent said bottom opening, said tangs being positioned adjacent a bottom rim of said liner to hold said liner in said interior cavity.

11. An article of headwear, comprising:

a hardhat having a front, a back, a visor outwardly extending from said front of said hardhat, an exterior surface, an interior cavity and a bottom opening into said interior cavity for receiving a head of a user therein;

said hardhat having a plurality of support struts in said interior cavity, said struts and said exterior surface of said hardhat defining therebetween an upper portion of said interior cavity;

said hardhat having a thickness defined between said exterior surface and said interior cavity, wherein said thickness of said hardhat in said upper portion of said interior cavity being less than said thickness of said hardhat in a remainder portion between said exterior surface and said interior cavity of said hardhat;

said hardhat having a plurality of vent holes therethrough extending between said exterior surface and said interior cavity of said hardhat, said vent holes being located in said upper portion of said interior cavity of said hardhat;

a fan being disposed in said upper portion of said interior cavity, said fan having a central hub and a plurality of blades outwardly radiating from said central hub of said fan, said central hub of said fan being rotatably mounted to said hardhat to permit rotation of said fan in said upper portion of said interior cavity;

a motor for rotating said fan, said motor being mounted to said hardhat in said upper portion of said interior cavity, a drive member operationally connecting said motor to said fan to rotate said fan, said drive member comprising an endless loop belt;

a battery being electrically connected to said motor, said battery being disposed in a compartment in said front of said hardhat, said hardhat having an access panel closing said compartment;

a switch being electrically connected to said motor, said switch being mounted to said front of said hardhat;

said switch having a pair of light sources on said front of sad hardhat for indicating when said motor is activated and deactivated by said switch, one of said light sources being illuminated when said motor is deactivated by said switch, the other of said light sources being illuminated when said motor is activated by said switch;

a temperature sensor being mounted to said hardhat in said interior cavity, said temperature sensor being electrically connected to said motor, said temperature sensor generating a first signal to said motor when said temperature sensor detects a temperature in said interior cavity greater than a first predetermined temperature;

said motor activating to rotate said fan upon receipt of said first signal from said temperature sensor;

said temperature sensor generating a second signal to said motor when said temperature sensor detects a temperature in said interior cavity less than a second predetermined temperature, said second predetermined temperature being less than said first predetermined temperature;

said motor deactivating upon receipt of said second signal from said temperature sensor;

a liner being inserted into said interior cavity between said struts and said bottom opening into said interior cavity;

said liner having a convex exterior surface and a concave interior surface defining a space adapted for receiving the head of a user therein;

said liner having a plurality of apertures therethrough extending between said exterior and interior surface of said liner;

said interior cavity having a front recess adjacent said bottom opening into said cavity and positioned towards said front of said hardhat;

said liner having a front lip outwardly extending therefrom, said front lip being extended into said front recess of said interior cavity;

said hardhat having a plurality of spaced apart resilient tangs extending inwardly into said interior cavity adjacent said bottom opening; and said tangs being positioned adjacent a bottom rim of said liner to hold said liner in said interior cavity.

12. An article of headwear, comprising:

a hardhat having an interior cavity and a bottom opening into said interior cavity for receiving a head of a user therein;

said hardhat having a plurality of vent holes therethrough;

a fan being mounted to said hardhat in said interior cavity;

a motor being mounted to said hardhat in said interior cavity for rotating said fan, said fan drawing air through said vent holes into said interior cavity when rotated by said motor; and a liner being inserted into said interior cavity, said liner having a plurality of apertures therethrough.

* * * * *